United States Patent [19]

Fukuroi

[11] 4,040,150

[45] Aug. 9, 1977

[54] SLIDE FASTENER HAVING DISCRETE COUPLING ELEMENTS

[75] Inventor: Takeo Fukuroi, Uozu, Japan

[73] Assignee: Yoshida Kogyo Kabushiki Kaisha, Japan

[21] Appl. No.: 668,042

[22] Filed: Mar. 18, 1976

[30] Foreign Application Priority Data

Mar. 27, 1975 Japan ..... 50-41734[U]

[51] Int. Cl.[2] ..... A44B 19/06

[52] U.S. Cl. ..... 24/205.13 R

[58] Field of Search ..... 24/205.13 R

[56] References Cited

U.S. PATENT DOCUMENTS

| | | | |
|---|---|---|---|
| 2,322,537 | 6/1943 | Morin | 24/205.13 R |
| 2,331,618 | 10/1943 | Morin | 24/205.13 R |
| 2,385,020 | 9/1945 | Morin | 24/205.13 R |
| 2,495,033 | 1/1950 | Sullivan | 24/205.13 R |
| 3,055,070 | 9/1962 | Morin | 24/205.13 R |
| 3,068,541 | 12/1962 | Morin | 24/205.13 R |

FOREIGN PATENT DOCUMENTS

| | | | |
|---|---|---|---|
| 935,935 | 7/1948 | France | 24/205.13 R |
| 2,313,353 | 10/1974 | Germany | 24/205.13 R |

*Primary Examiner*—Bernard A. Gelak
*Attorney, Agent, or Firm*—Bucknam and Archer

[57] ABSTRACT

A slide fastener is provided which comprises a pair of oppositely disposed stringer tapes each carrying along its longitudinal edge a series of uniformly spaced fastener elements. Each of the fastener elements has a pair of openings in the rounded front end face of its coupling end portion, and a pair of lugs on the shoulders of its neck portion. The lugs are complementary in shape to the openings and so disposed as to snugly fit in the corresponding openings of adjacent fastener elements of the companion stringer tape when the fastener elements on the tapes are coupled together.

3 Claims, 4 Drawing Figures

SLIDE FASTENER HAVING DISCRETE COUPLING ELEMENTS

BACKGROUND OF THE INVENTION

1. Field of the Invention

The present invention relates generally to slide fasteners and more particularly to slide fasteners of the type having a series of discrete fastener elements made of a synthetic resin secured to each of a pair of oppositely disposed stringer tapes.

Still more specifically, this invention deals with a slide fastener of the type described which incorporates an improvement in the fastener elements whereby the elements once coupled together are retained in place against displacement relative to each other particularly in a direction perpendicular to the plane of the slide fastener when the latter is subjected to longitudinal or lateral bending stresses, or torsional stresses while in use.

2. Prior Art

In one such prior art slide fastener, each individual fastener element was provided at the front end of its coupling portion with a horizontally extending, elongate slot or recess for receiving corresponding projections formed on a mating fastener element when the two stringer tapes are taken into engagement with each other.

Another prior art fastener element included a pair of slots formed in opposite sides of the coupling end portion and extending along the length of each fastener element.

A common drawback of these known slide fasteners is that when severe bending or torsional stresses are applied to the stringer tapes, the pronjections received in the corresponding slot are susceptible to accidental separation from the latter, resulting in a malfunctioned slide fastener.

This difficulty arises out of the fact that the mechanical strength of the fastener element is considerably reduced at its coupling portion on account of the provision of such continuous slots which tend to be deformed in the direction of the thickness of the coupling end portion under the influence of increased bending or torsional stresses.

SUMMARY OF THE INVENTION

It is therefore a primary object of this invention to provide a slide fastener of the type wherein the fastener elements once coupled together are retained in place against displacement relative to each other particularly in a direction perpendicular to the plane of the slide fastener even when the latter is subjected to severe longitudinal or lateral bending stresses, or torsional stresses while in use.

According to the invention, there is provided, in a slide fastener of the type including a pair of stringer tapes, and a series of uniformly spaced fastener elements carried on each of said stringer tapes, each of the fastener elements having a generally rectangular body which has a coupling end portion and a pair of parallel spaced apart legs extending rearwardly therefrom to hold a longitudinal edge portion of said stringer tapes therebetween, said coupling end portion projecting beyond the longitudinal edge at right angles to the axis of the slide fastener, and having a rounded head and a neck integral therewith, said head and said neck being complementary in shape to each other, said neck portion being defined by a pair of recesses disposed symmetrically with respect to the axis of said body, the improvement wherein said head portion has a pair of openings formed in the rounded front end face thereof, each of said openings being defined by a pair of parallel spaced apart, opposed upper and lower walls and a pair of vertical walls extending therebetween, and said neck portion including a pair of lugs at sides thereof adjacent said legs, said lugs being complementary in shape to said openings and so disposed as to snugly fit in the corresponding openings of adjacent fastener elements of the companion stringer tape when the fastener elements on said tapes are coupled together.

Other objects and features of the present invention will become manifest to those versed in the art upon making reference to the detailed description of the accompanying drawing.

DESCRIPTION OF THE PREFERRED EMBODIMENT

Figure 1:
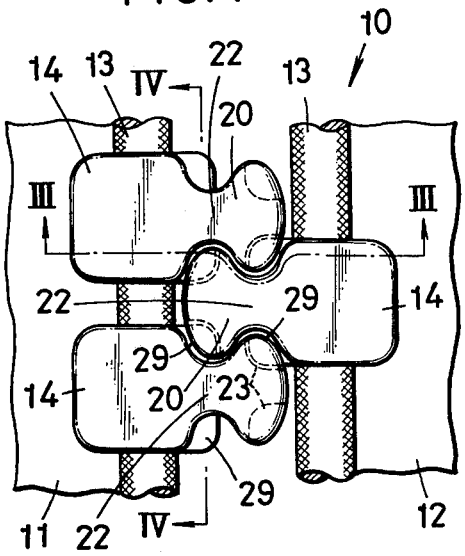
FIG. 1 is a fragmentary plan view of a slide fastener provided in accordance with the invention, showing the fastener elements on respective stringer tapes coupled together.

Referring to the drawing and FIG. 1 in particular, there is provided a slide fastener generally designated at 10 which comprises a pair of identical stringer tapes 11, 12, the opposed longitudinal edges of which are beaded or reinforced as indicated at 13. Carried on the beaded edge of each stringer tape are a series of uniformly spaced fastener elements 14 embodying the present invention. The fastener elements on the stringer tapes 11, 12 are taken into and out of engagement with each other by a reciprocating slider (not shown) to close or open the slide fastener in the usual manner.

Each of the fastener elements 14 comprises a generally rectangular body 15 having upper and lower legs 16, 17 spaced apart from each other and a transversely extending slot 18 defined therebetween, said legs embracing the inner edge portion of the stringer tape. The slot 18 is enlarged into a substantially circular cross section as at 19 for accommodating the beaded edge 13 of the tape. The upper and lower legs 16, 17 are substantially identical in shape, and are generally square when viewed in a direction perpendicular to the plane of the slide fastener 10, as shown in FIG. 1.

The body 15 of each fastener element 14 also includes a coupling end portion 20 extending forwardly from the upper and lower legs 16, 17 and having a rounded arcuate head 21 and a reduced neck portion 22 integral therewith. The coupling end portion 20 projects beyond the beaded edge 13 of the stringer tape at right angles to the axis of the slide fastener 10. As best shown in FIG. 1, the neck portion 22 is defined by a pair of recesses formed symmetrically with respect to the axis of the fastener element body 15. It will be appreciated that the head 21 and neck portions 22 are disposed in complementary relation to each other so as to be interengageable upon movement of the slider in a direction to close the slide fastener.

Figure 2:
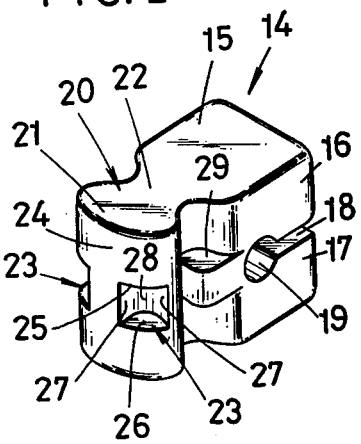
FIG. 2 is a perspective view of one individual fastener element embodying the invention.

According to an important aspect of the invention, the head portion 21 has a pair of openings 23 formed in its rounded front end face 24, each of the openings having a substantially triangular transverse cross-sectional shape as shown in FIG. 2. The openings 23 are located approximately intermediate of the height of the coupling end portion 20 and are spaced equidistant from the axis of the fastener element body 15. Each of the openings 23 is defined by a pair of parallel spaced apart, opposed upper and lower walls 25, 26 and a pair of vertical walls 27 extending therebetween, the upper and lower walls 25, 26 being substantially identically triangular in shape. The vertical walls 27 converge toward each other and merge into a corner 28. When viewed in the direction of the length of the fastener element body 15, the openings 23 are substantially square in shape, as seen in FIG. 2.

The neck portion 22 includes a pair of lugs 29 at sides thereof adjacent the legs 16, 17, the lugs 29 being located approximately intermediate of the height of the coupling end portion 20 and being complementary in shape to the openings 23 so as to snugly fit in the corresponding openings 23 of adjacent fastener elements 14 of the companion stringer tape 11 (12) when the fastener elements are taken into engagement with each other by the movement of the slider along the edges of the stringer tapes.

Figure 3:
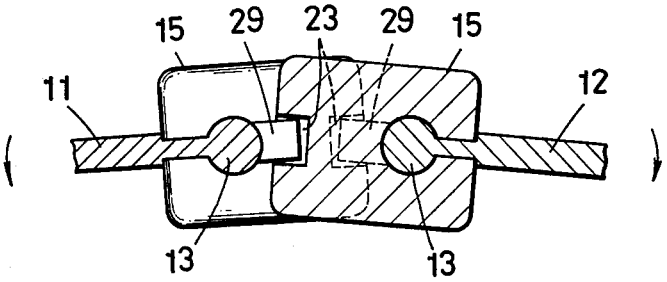
FIG. 3 is a cross-sectional view taken along the line III—III of FIG. 1, showing the stringer tapes flexed about the longitudinal axis of the slide fastener.

It will be appreciated that when the coupled stringer tapes 11, 12 are bent or flexed about the longitudinal axis of the slide fastener 10 in the manner shown in FIG. 3, the lugs 29 received in the corresponding openings 23 will act upon the upper and lower walls 25, 26 to urge the same away from each other.

Figure 4:
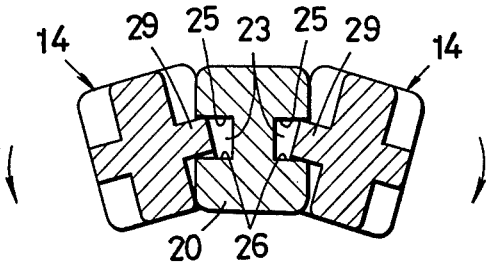
FIG. 4 is a cross-sectional view taken along the line IV— IV of FIG. 1, showing the stringer tapes flexed longitudinally of the slide fastener.

In the event that the coupling stringer tapes 11, 12 are bent or flexed longitudinally of the slide fastener 10 in the manner as shown in FIG. 4, the lugs 29 received in the corresponding openigs 23 will also act upon the upper and lower walls 25, 26 to urge the same away from each other.

Advantageously, the two split openings 23 advanced hereinabove are relatively small as compared to the prior art continuous one-piece openings and hence less liable to deformation when subjected to severe stresses applied particularly in the direction of the thickness of the coupling end portion.

Thus, the fastener stringer tapes 11, 12 can be maintained in their properly coupled condition without encountering any unintentional disengagement or mismeshing of the fastener elements.

What is claimed is:

1. In a slide fastener of the type including a pair of stringer tapes, and a series of uniformly spaced fastener elements carried on each of said stringer tapes, each of the fastener elements having generally rectangular body which has a coupling end portion and a pair of parallel spaced apart legs extending rearwardly therefrom to hold a longitudinal edge portion of said stringer tapes therebetween, said coupling end portion projecting beyond the longitudinal edge at right angles to the axis of the slide fastener, and having a rounded head and a neck integral therewith, said head and said neck being complementary in shape to each other, said neck portion being defined by a pair of recesses disposed symmetrically with respect to the axis of said body, the improvement wherein said head portion has a pair of openings formed in the rounded front end face thereof, each of said openings being defined by a pair of parallel spaced apart, opposed upper and lower flat walls and a pair of vertical walls extending therebetween, said vertical walls extending at an angle to each other, and said neck portion including a pair of lugs at sides thereof adjacent said legs, said lugs being complementary in shape to said openings and so disposed as to snugly fit in the corresponding openings of adjacent fastener elements of the companion stringer tape when the fastener elements on said tapes are coupled together, said lugs having flat surfaces that engage respective upper and lower flat walls of said openings to limit relative tilting displacement of coupled adjacent fastener elements when said tapes are flexed.

2. The improvement according to claim 1 wherein said pair of openings are disposed intermediate of the height of said coupling end portion and spaced equidistant from the axis of said body.

3. The improvement according to claim 1 wherein each of said openings has a substantially triangular transverse cross-sectional shape.

* * * * *